US007488284B2

(12) United States Patent
Hanson et al.

(10) Patent No.: US 7,488,284 B2
(45) Date of Patent: Feb. 10, 2009

(54) IMPLANTABLE PROSTHESIS WITH DIRECT MECHANICAL STIMULATION OF THE INNER EAR

(75) Inventors: Jean-Noël Hanson, Faches-Thumesnil (FR); Guy Charvin, Antibes (FR); François Vanecloo, Lille (FR)

(73) Assignees: MXM, Vallauris (FR); S. C. Pacloo, Lille (FR); J. Hanson, Faches-Thumesnil (FR)

( * ) Notice: Subject to any disclaimer, the term of this patent is extended or adjusted under 35 U.S.C. 154(b) by 0 days.

(21) Appl. No.: 10/587,380

(22) PCT Filed: Jan. 24, 2005

(86) PCT No.: PCT/FR2005/000155

§ 371 (c)(1),
(2), (4) Date: Apr. 2, 2007

(87) PCT Pub. No.: WO2005/084075

PCT Pub. Date: Sep. 9, 2005

(65) Prior Publication Data

US 2007/0249889 A1 Oct. 25, 2007

(30) Foreign Application Priority Data

Jan. 29, 2004 (FR) ..... 04 00834

(51) Int. Cl.
*H04R 25/00* (2006.01)

(52) U.S. Cl. ..... 600/25

(58) Field of Classification Search ..... 600/25; 607/55–57; 381/312–331; 181/129–137
See application file for complete search history.

(56) References Cited

U.S. PATENT DOCUMENTS 5,498,226 A 3/1996 Lenkauskas

FOREIGN PATENT DOCUMENTS

WO WO 97/30565 8/1997
WO WO 03/099177 12/2003

*Primary Examiner*—John P Lacyk
(74) *Attorney, Agent, or Firm*—Harness, Dickey & Pierce, PLC

(57) ABSTRACT

A prosthesis for stimulation of the inner ear, comprising means for excitation which generate vibrations which can excite the ear of a patient, and an implantable part comprising a rod which can transmit vibrations and which is configured in such a way that it can directly transmit vibrations generated by the means of excitation to the inner ear of a patient.

22 Claims, 5 Drawing Sheets

Fig. 1
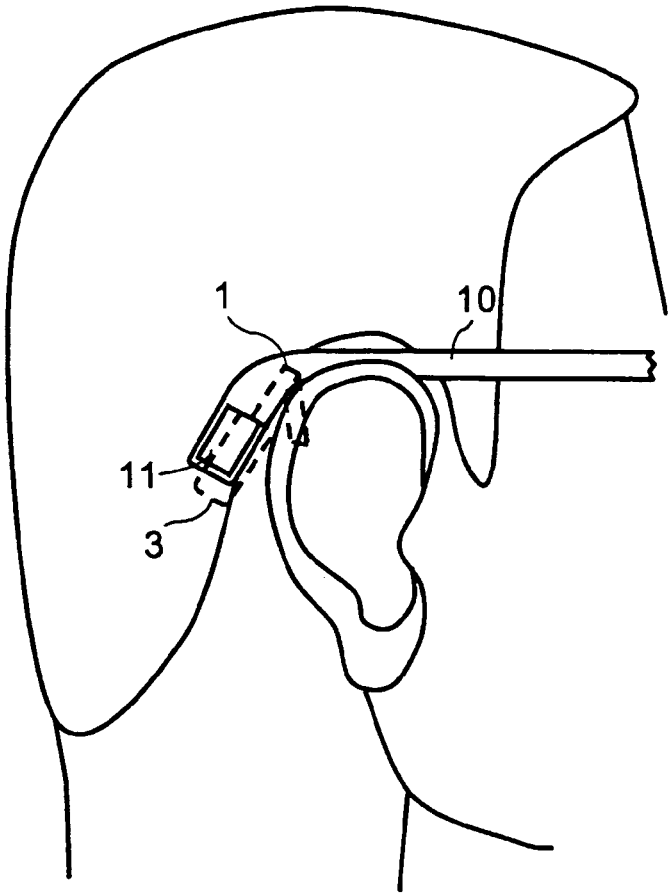
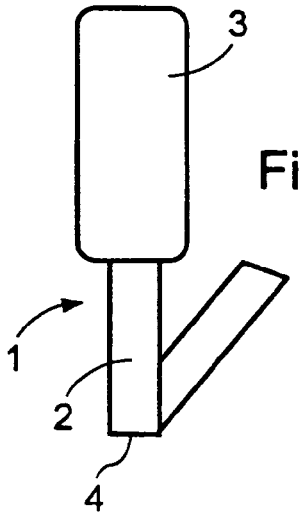
Fig. 2
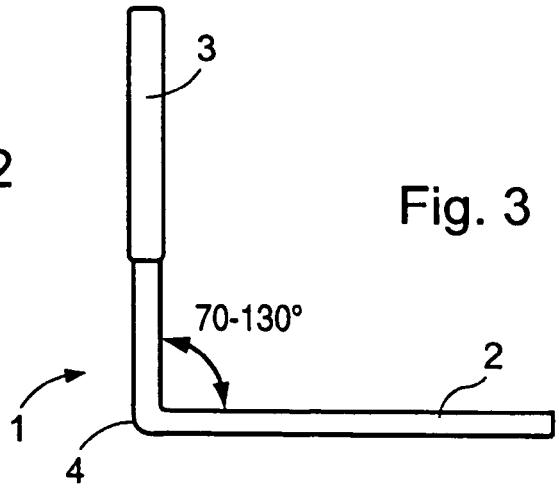
Fig. 3
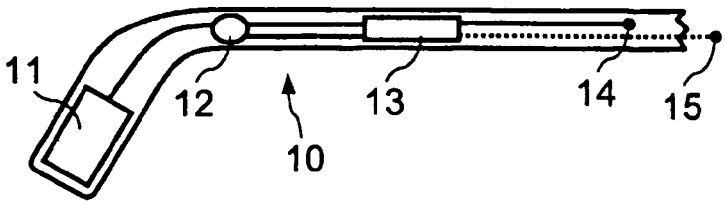
Fig. 4

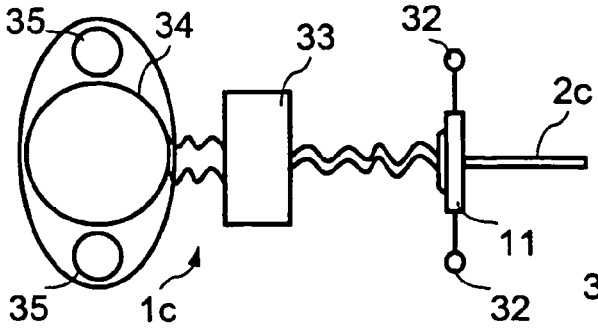
Fig. 13
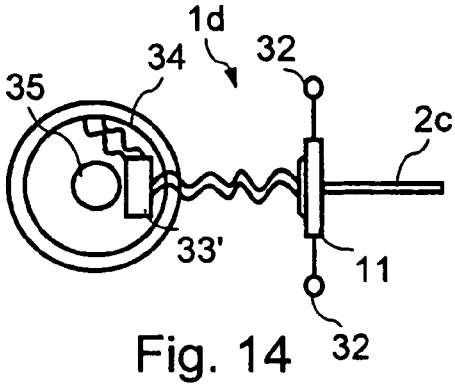
Fig. 14
Fig. 15
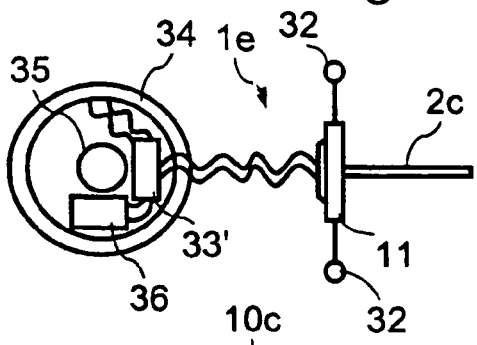
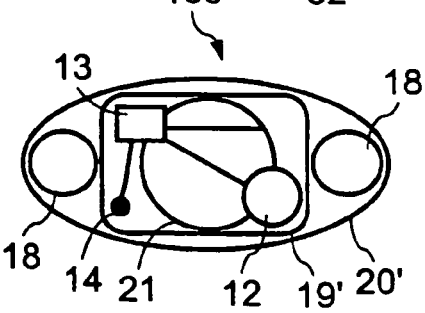
Fig. 17
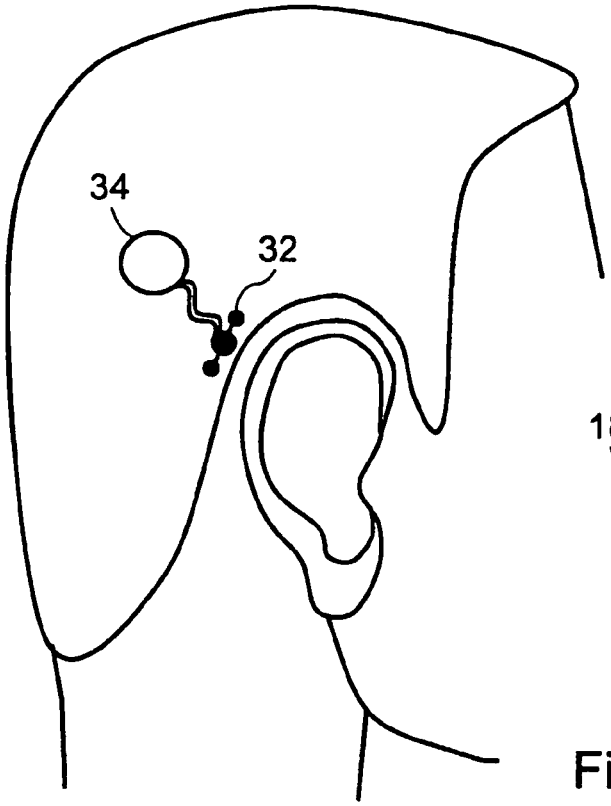
Fig. 16
Fig. 18
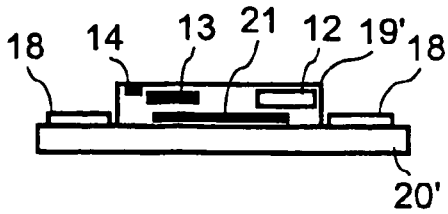

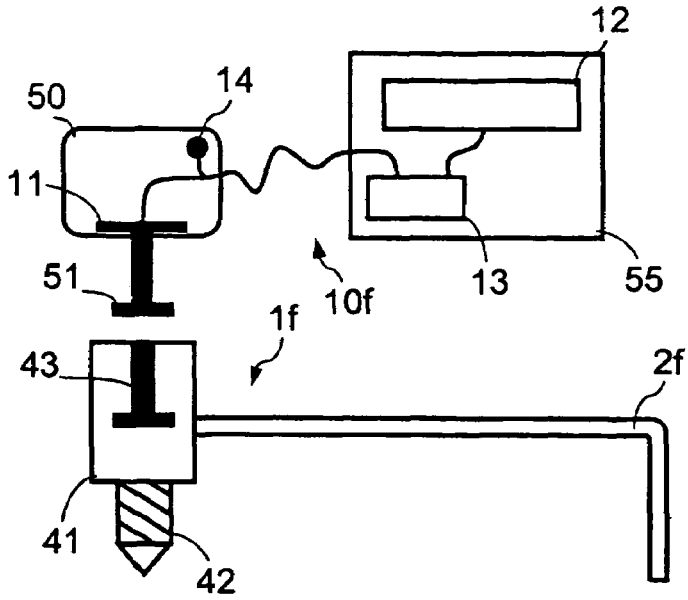
Fig. 21
Fig. 19
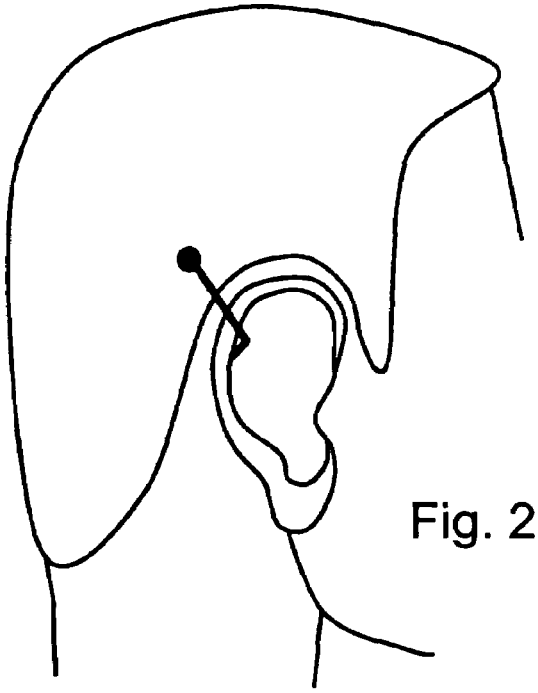
Fig. 20
Fig. 22
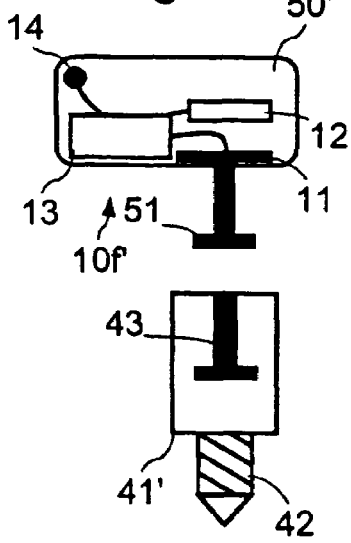
Fig. 24
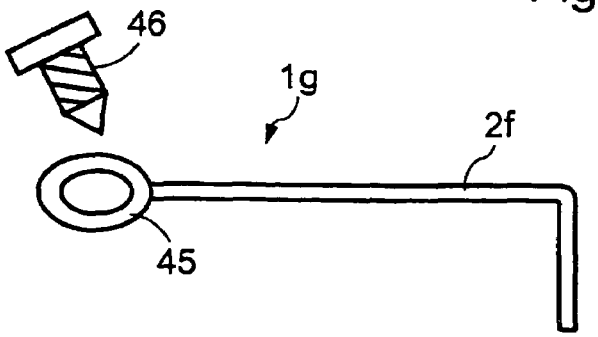
Fig. 23

IMPLANTABLE PROSTHESIS WITH DIRECT MECHANICAL STIMULATION OF THE INNER EAR

FIELD

The present disclosure relates to ear stimulation prostheses for rehabilitation of patients with disorders of the inner ear.

BACKGROUND

The inner ear is a sensory organ of which the function is to transcribe vibration waves between 0 and 20 kHz from the environment into a sensory inflow. It includes two physically distinct portions having two different respective functions, namely the balance portion and the hearing portion.

The balance portion, called the vestibule, has the function of encoding vibration waves between 0 and 800 Hz. It also makes it possible to situate the direction of the head with respect to its environment, by acceleration measurement systems in the semicircular canals. The hearing portion, called the cochlea, encodes the vibration waves between 20 Hz and 20 kHz.

The pathologies that may affect the inner ear can primarily be classified into three categories, namely loss of auditory acuity, balance disorders and tinnitus.

The main cause of these pathologies is associated with the natural aging of the sensory cells, resulting in hearing disorders (presbycusis, age-related deafness) and balance disorders (vestibulopathy, age-related hypoflexia).

Some diseases, such as Meniere's disease, can trigger all three types of pathologies (deafness, tinnitus and vertigo).

There are a number of possibilities for treatment of these pathologies. For some cases of deafness associated with transmission and vestibular disorders, there are surgical treatments, such as the opening of endolymphatic sacs or vestibular nerve section or middle ear surgeries. These treatments have the disadvantage of being irreversible.

Some drugs or rehabilitation treatments can attenuate vertigo, tinnitus and sudden or fluctuating deafness. These treatments do not cure the disease, but simply enable the affects thereof to be reduced. These pathologies can also be treated with an apparatus. However, there is currently no apparatus enabling all of these pathologies to be treated.

For deafness, hearing aids are designed to amplify the acoustic waves. They are commonly used to treat all levels of deafness, from slight to profound. There are also systems implanted into the middle ear, which are designed to mechanically amplify the movements of the ear ossicles (U.S. Pat. Nos. 5,913,815 and 6,293,903). There are systems for bone conduction, by means of a vibrator integrated in a pair of eyeglasses, for example, which are designed to cause the skull to vibrate so as to transmit the vibration wave to the inner ear. These latter systems are limited to the treatment of deafness associated with a transmission problem, because the pressure exerted on the skin to transmit the vibration to the skull must be limited. There are also implanted bone conduction systems in which the vibrator is either implanted or can be connected by an opening in the skin to an implant attached to the skull (U.S. Pat. No. 4,498,461, WO 02/09622). Electric stimulators (intra- or extra-cochlear implants), directly stimulating the auditory nerve, are used in cases of significant deafness, i.e. when the acoustic waves are insufficient for stimulating the auditory nerve.

There is no apparatus for vertigo. For tinnitus, a masking system has been proposed, which sends a noise to the inner ear to mask the tinnitus (U.S. Pat. No. 5,325,872). In addition, external hearing aids make it possible to correct tinnitus associated with deafness: the correction of the deafness leads to a reduction in the tinnitus. Electric stimulators of the inner ear are also used to reduce tinnitus, when the deafness is too severe to be treated acoustically.

Hearing aids and masks have the advantages of not requiring surgery and of being reversible and compatible with MRI. However, they are generally relatively visible, and therefore unaesthetic. In addition, they sometimes have contraindications (aplasia of the outer ear, external otitis, eczema, and so on). They often cause acoustic feedback due to their structure and in particular the closeness of the microphone to the earphone. Some of these apparatuses require plugging the auditory canal, which raises the problem of amplification of low-frequency sounds, and is often disturbing for the patient who then hears more body sounds (chewing, blood circulation). Moreover, these apparatuses operate only on a frequency band between 125 and 6000 Hz due to the use of an earphone.

Systems implanted in the middle ear, on the other hand, are discreet and do not require blocking of the auditory canal. They cause little acoustic feedback, thereby allowing for more high-frequency sounds than with hearing aids. They cause less distortion and operate in a wider frequency band (up to 10 kHz) because they do not use an earphone. However, they require surgery of the middle ear and general anesthesia, with all of the risks of these operations (facial nerve, ear ossicles), which makes them relatively irreversible and incompatible with MRI and radiotherapy, and raises problems in the event of a breakdown or failure of the apparatus. By comparison with hearing aids, these apparatuses are relatively expensive, and if the deafness changes, their capacity for adjustment is limited due to the use of an electromagnetic transducer. Moreover, their bandwidth does not cover the entire spectrum to which the inner ear is normally sensitive (limited to frequencies between 125 Hz and 10 kHz).

Non-implanted or semi-implanted bone conduction systems have the advantage of providing quality sound. They do not require the auditory canal to be plugged either, and do not generate acoustic feedback. However, they are highly visible and therefore unaesthetic, and consume a large amount of power. Moreover, they provide little or no left/right selectivity due to the mode of transmission used (through a skull bone). Non-implanted systems must clamp the skin (conduction of vibrations through the skin), which is uncomfortable for the patient, and even painful, and can cause necrosis of the skin. Semi-implanted systems requiring a permanent opening in the skin barrier lead to risks of infection.

Cochlear implants require complex surgery, therefore with risks, which is irreversible, presenting a problem in the event of failure of the treatment or breakdown of the apparatus. They are incompatible with imaging systems, expensive, and their bandwidth is limited to frequencies between 125 and 6000 Hz.

SUMMARY

This invention is intended to overcome these disadvantages. This objective is achieved by providing an inner ear stimulation prosthesis including excitation means designed to cause vibrations capable of exciting the ear of a patient.

According to the invention, this prosthesis comprises an implantable portion, including a rod capable of transmitting vibrations and that is designed so as to be capable of transmitting the vibrations generated by the excitation means directly to the patient's inner ear.

The rod is advantageously designed to be placed in contact with a semicircular canal of the patient's inner ear, preferably the external semicircular canal of the patient's inner ear.

According to a special feature of the invention, the rod is made of a hard and rigid biocompatible material chosen from metals, plastic materials, and ceramic materials.

The rod advantageously has a cross-section with a flattened shape.

According to a special feature of the invention, the rod comprises at least one elbow so as to be capable of connecting an external portion of the patient's skull with the inner ear without requiring complex surgery involving total anesthesia of the patient.

The rod preferably has a length between the elbow and its end in contact with a portion of the patient's inner ear of between 20 and 30 mm and has an elbow angle between its two end portions of between 70° and 130°.

The surface of the implantable portion is also preferably treated so as to prevent any osseointegration.

The rod is preferably pivotably mounted on a support.

According to a special feature of the invention, the excitation means are arranged in an external casing and are designed to generate vibrations intended to be transmitted through the patient's skin to a plate rigidly connected to the rid.

The plate preferably has a substantially rectangular shape with foam edges of which the length is between 6 mm and 20 mm and the width is between 3 mm and 10 mm.

According to a special feature of the invention, the external casing is integrated in an object capable of being held on the patient's head so that the excitation means are arranged opposite the plate of the implantable portion.

The object capable of being held on the patient's head is preferably selected from either a pair of eyeglasses or a casing that fits around the ear.

According to a preferred embodiment of the invention, the external casing includes at least one magnetic part intended to cooperate with at least one magnetic part provided in the implantable portion in order to hold the excitation means opposite the plate.

According to a preferred embodiment of the invention, the excitation means are integrated in the implantable portion and coupled directly with the rod.

According to a preferred embodiment of the invention, the rod is rigidly connected to attachment means for attaching the rod to the patient's skull bone.

The excitation means are preferably housed in an external casing equipped with coupling means, so as to be removable attached through the patient's skin to attachment means intended to be attached to the patient's skull bone.

According to a preferred embodiment of the invention, the external casing containing a microphone is intended to be attached on the side of a totally defective ear of the patient, while the rod is intended to be attached so as to excite the other non-defective ear of the patient, with the vibrations generated by the excitation means being transmitted to the rod by bone conduction of the patient's skull bone.

The invention also relates to a hearing aid, and/or a prosthesis for neurostimulation against tinnitus and/or balance disorders, having at least one of the features disclosed above.

The invention also relates to an implantable prosthesis portion, consistent with one of the features disclosed above.

Because it does not involve the ear ossicles or the middle ear, the prosthesis according to the invention can be implanted by a simple surgical procedure requiring only local anesthesia. Such surgery therefore has few of the risks of surgical complications, and is reversible.

Because a vibration is transmitted directly to the inner ear, the prosthesis according to the invention makes it possible to transmit the entire frequency band (0 to 20 kHz) to which the inner ear is normally sensitive. The prosthesis according to the invention can therefore be used as an auditory prosthesis, and/or as a neurostimulation prosthesis for fighting tinnitus and/or balance disorders.

In the case of hearing correction, it provides the possibility of significant amplification without the risk of generating acoustic feedback. It therefore makes it possible to correct all disorders of the ear (deafness, tinnitus, balance). Because the inner ear is directly stimulated, the left/right selectivity is very good, which allows for selective and appropriate correction of the two ears independently of one another. Moreover, the prosthesis according to the invention does not require even partial plugging of the external auditory canal.

DRAWINGS

A preferred embodiment of the invention will be described below, by way of a non-limiting example, in reference to the appended drawings, in which:

FIG. 1 diagrammatically shows an implantable prosthesis according to the invention, installed on the patient's head;

FIGS. 2 and 3 respectively show, in greater detail, in perspective and in a side view, the implantable portion of the prosthesis shown in FIG. 1;

FIG. 4 shows in greater detail, in a front view, the external portion of the prosthesis shown in FIG. 1;

Figure 7A:
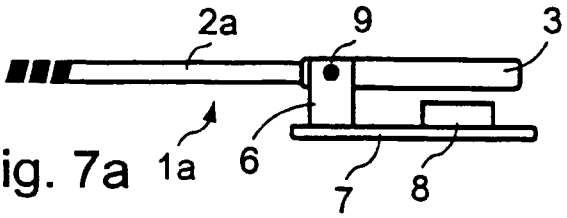
Figure 8:
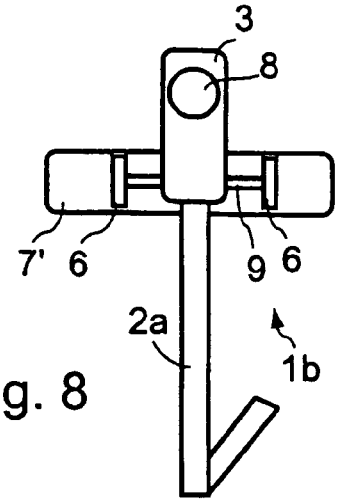
Figure 7B:
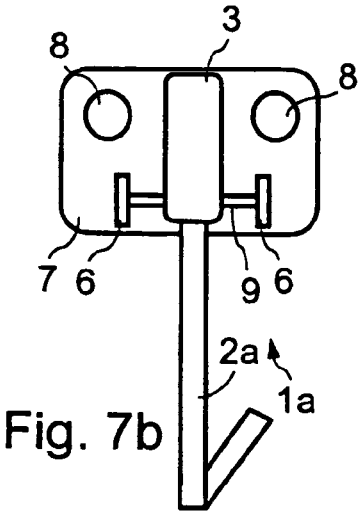
Figure 9:
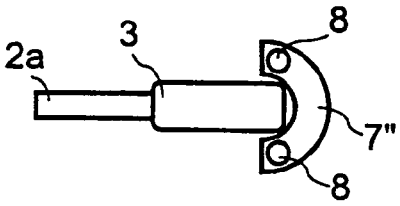

FIGS. 7*a* and 7*b* respectively show, in a partial profile and a front view, an alternative of the implantable portion of the prosthesis according to the invention;

FIGS. 8 and 9 show, in a front view, alternatives of the external portion of the prosthesis shown in FIGS. 7*a* and 7*b;*

Figure 11:
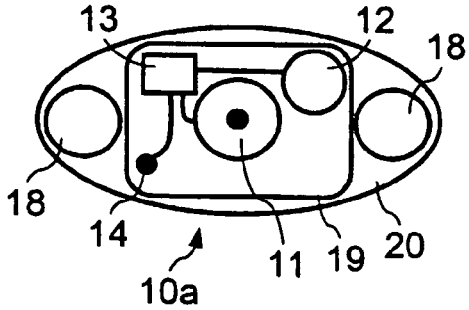
Figure 10:
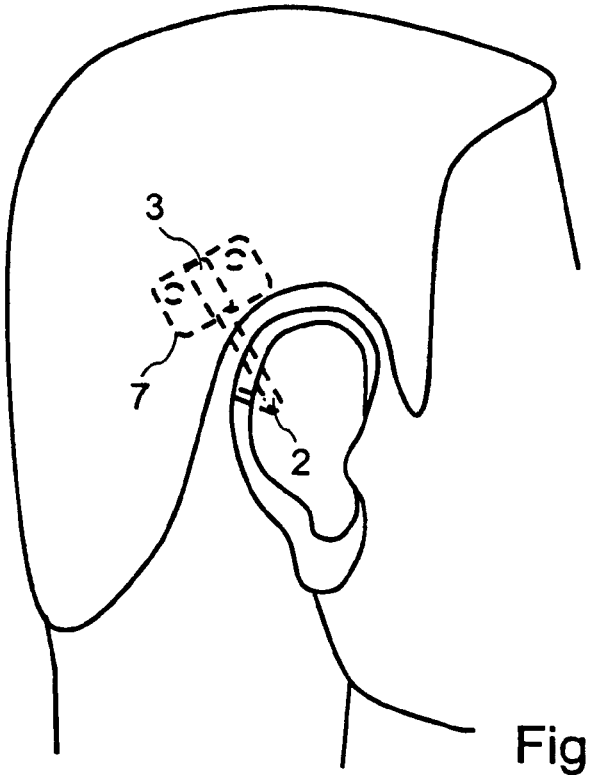
Figure 12:
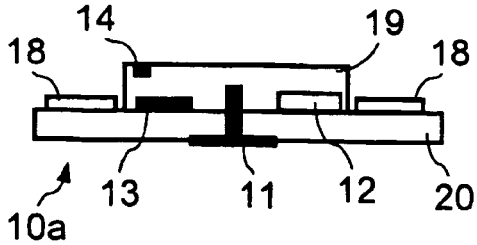

FIG. 10 shows the way in which the implantable portion of the prosthesis shown in FIGS. 7*a*, 7*b* and 9 is attached to a patient's head;

FIGS. 11 and 12 respectively show, in front and profile views, the external portion of the prosthesis corresponding to the implantable portion shown in FIGS. 7*a*, 7*b* and 9;

FIGS. 13 and 14 show two other alternatives of the implantable portion of the prosthesis according to the invention;

FIG. 15 shows another entirely implantable alternative of the prosthesis according to the invention;

FIG. 16 shows the way in which the implantable portion of the prosthesis shown in FIG. 15 or 16 is attached to a patient's head;

FIGS. 17 and 18 respectively show, in front and profile views, the external portion of the prosthesis corresponding to the implantable portion shown in FIG. 13 or 14;

FIG. 19 shows another alternative of the implantable portion of the prosthesis according to the invention;

FIG. 20 shows the way in which the implantable portion of the prosthesis shown in FIG. 19 is attached to a patient's head;

FIGS. 21 and 22 show two alternatives of the external portion of the prosthesis corresponding to the implantable portion shown in FIG. 19;

FIG. 23 shows the implantable portion of an alternative of the prosthesis shown in FIGS. 19 and 20;

FIG. 24 shows another implantable portion intended to be associated with the implantable portion shown in FIG. 22.

DETAILED DESCRIPTION

FIG. 1 shows an implantable prosthesis according to the invention. In this figure, the prosthesis includes an entirely passive implantable portion 1 designed to transmit vibrations to the inner ear, preferably at the level of the semicircular canals, and an external portion 10 integrating excitation means 11, such as a vibrator, intended to cooperate with the implantable portion 1. The external portion can also comprise signal processing means, one or more microphones, and/or other electronic and/or power elements.

In FIGS. 2 and 3, the implantable portion 1 includes a plate 3, preferably in the form of a reverse cup, connected to a rod 2. The plate is intended to be implanted under the skin in contact with the patient's skull, preferably behind the ear (FIG. 1), so as to receive, through the skin, the excitation produced by the external portion 10. The implantable rod 1 advantageously forms at least one elbow 4 so that the angle between the plate 3 and the end of the rod 2 is between 70° and 130°, so as to reach the inner ear through the antrostomy cavity from the external surface of the skull. Owing to the elbow 4, the implantable rod allows for acoustic piston-type transmission. The presence of an elbow also makes it possible to prevent a shock on the plate 3 from causing trauma due to pressure of the rod on the structures of the inner ear.

The implantable portion 1 constituted by the plate 3 and the rod is advantageously made in a single piece with foam edges, of a hard and rigid biocompatible material such as a biocompatible metal (for example, titanium, etc.), or a hard biocompatible plastic or ceramic material, which is selected so as to be a very good vibration transmitter, and preferably compatible with MRI and radiotherapy.

The rod 2 advantageously has a cross-section with a flattened shape, for example, rectangular with foam edges, around 3 mm wide and 1.5 mm thick. These dimensions make it possible to ensure good transmission of vibrations between the plate and the inner ear, while reducing the risks of trauma to the skin. The length of the rod between the elbow 4 and its distal end intended to come into contact with the inner ear is advantageously between 20 and 30 mm, and preferably between 24 and 26 mm.

The distal portion of the rod 2 can have a non-flattened section so as to fit the body and concentrate the vibrations at the zone to be stimulated. The distal end of the rod 2 can advantageously have a shoe for facilitating its positioning and reducing the risk of trauma in the event of a shock.

The plate 3 advantageously has a rectangular shape of which the length is between 6 and 20 mm and the width is between 3 and 10 mm, so as to prevent risks of trauma and even tearing of the skin, which may occur if the plate is too small or too large. These dimensions also allow for good transmission of the vibrations generated by the vibrator 11 through the skin, which limits the pressure to be exerted on the skin between the vibrator and the plate 3.

The end of the rod 2 is advantageously implanted so as to come into contact with the semicircular canals of the inner ear, which have the advantage of being very sensitive, preferably with the external semicircular canal, which is easily accessible by minor surgery requiring only local anesthesia.

More specifically, the rod is implanted using a tympanoplasty technique with retroauricular access followed by antrostomy and identification of the contact zone of the distal end of the rod 2. The rod 2 is then applied so that its distal end comes into contact with the shell of a semicircular canal, preferably the external semicircular canal, which is easier to reach. When the rod is in place, its elbow 4 reaches the height of the mastoid cortical bone, and the plate 3 is arranged in the retroauricular region away from the acoustic horn so as to prevent acoustic feedback phenomena.

To fit the rod to the patient's body, it is possible to provide the surgeon with a measuring tool such as a graduated rod or a malleable gauge for determining the length of the rod between the elbow and its distal end and the angle of the elbow. Next, it is possible to provide the surgeon with a set of rods having different lengths and possible elbow angles so that he/she can choose the appropriate rod for the patient's body. Alternatively, or in combination, it is possible to provide tools for fitting the rod to the patient's body, and for adjusting the angle of the elbow and/or the length of the rod between its elbow and its distal end.

The implantable portion 1 preferably has a treated surface so as to prevent any osseointegration. The implantable portion 1 can also be covered with a coating of a relatively or entirely non-osseointegratable material, for example, silicone, PTFE or parylene.

In FIG. 4, the external portion includes excitation means 11 intended to be applied to the skin opposite the plate 3, as shown in FIG. 1. The external portion can also include a signal processor 13 powered by a cell or a battery 12, and connected to the excitation means and possibly to a microphone 14, and, if necessary, to one or more optional microphones 15 intended, for example, to be arranged near the other ear if it is entirely deaf.

In FIGS. 1 and 4, the external portion is advantageously integrated in a temple of the eyeglass frame, with the vibrator 11 being arranged in the end region of the eyeglass temple intended to be applied behind the patient's ear, so as to be opposite the plate 3 of the implantable portion 1. By thus equipping the two temples of a pair of eyeglasses, it is possible to correct both ears of the patient, with the implantation of an implantable rod 1 in each ear. This provision makes it possible to correct problems of deafness and/or tinnitus and/or a balance disorder.

The external portion 10 can also be integrated in any other object intended to be installed on the head, such as a headband or a headpiece, or a hair barrette. It can also be attached to the skull by transcutaneous anchoring.

The prosthesis described in reference to FIGS. 1 to 4 also has the advantages of being very discreet and of preserving the skin barrier. Owing to the use of a rod conducting the vibrations directly to the inner ear, the transmission of vibrations through the skin does not require the skin to be clamped in a manner that is uncomfortable for the patient. Moreover, as the implantable portion is entirely passive, it does not present any risk of breakdown (by comparison with active implantable systems).

Figure 5:
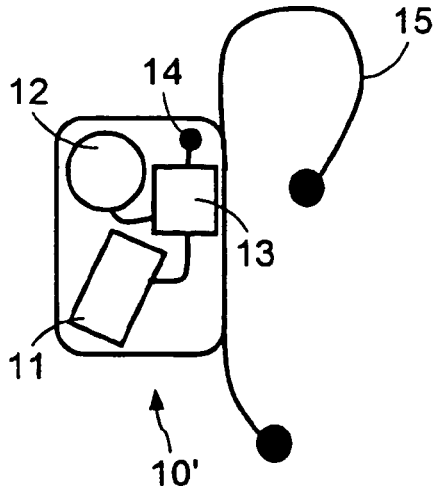
FIG. 5 shows, in a front view, an alternative of the external portion of the prosthesis shown in FIG. 1.
Figure 6:
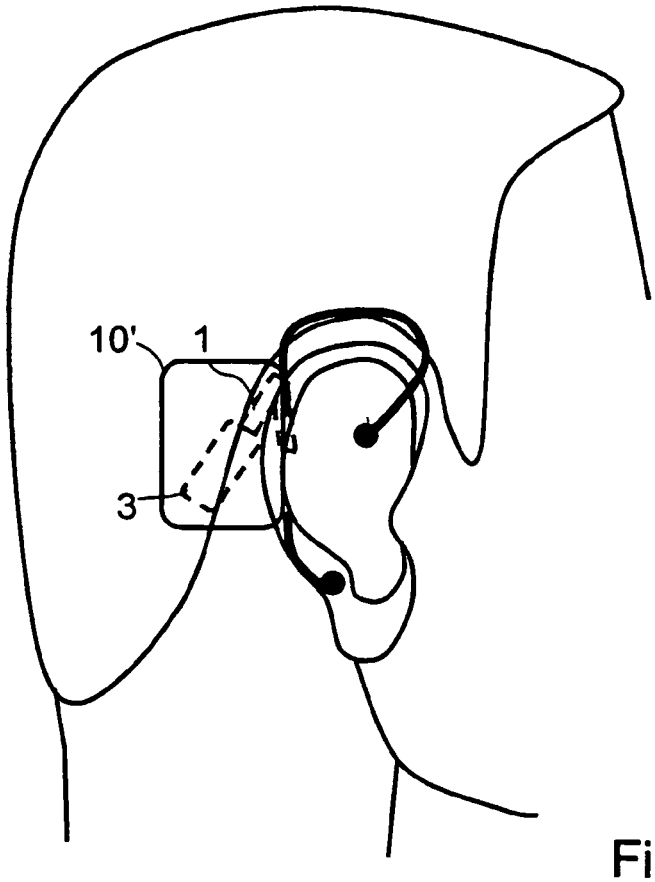
FIG. 6 shows the way in which the external portion of the prosthesis shown in FIG. 5 is worn by the patient.

FIGS. 5 and 6 show an alternative of the external portion. In this figure, the external portion 10' includes the vibrator 11, and possibly the processor 13, the microphone 14 and the cell or battery 12, which external portion is housed in a casing rigidly connected to the attachment means 15 that fit around the ear, enabling the vibrator 11 to be held opposite the plate 3 of the implantable portion 1.

FIGS. 7*a*, 7*b* and 8 show alternatives of the implantable portion comprising a rod 2*a* rigidly connected to a plate 3 preferably pivotably mounted on a plate 7, 7' thus comprising supports 6 extending perpendicularly with respect to the plate 7, 7' and supporting swivels 9 positioned in cavities provided in the lateral sides of the plate 3 and forming a pivot pin. In FIGS. 7*a* and 7*b*, the plate 7 also supports two magnetic parts 8 such as magnets, provided for the attachment of an external casing.

In FIG. 8, a magnetic part 8 such as a magnet is attached to the plate 3, whereas no magnetic part is attached to plate 7', so that the latter can be smaller than the one shown in FIGS. 7 and 8.

It is also possible to consider mounting the magnetic parts 8 directly onto the plate 3 or onto a positioning part 7'', for example in an arc of circle associated with the plate 3, as shown in FIG. 9. Then, the plate 3 is not associated with a plate 7, 7' on which it is pivotably mounted.

In FIG. 10, the implantable portion 1*a*, 1*b* is implanted under the patient's skin, in the temporo-occipital zone, or substantially in the mastoid region, so that the rod 2*a* has a length between the plate 3 and the elbow 4 that is greater than that shown in FIGS. 1 to 4.

In FIGS. 11 and 12, the external portion 10*a* of the prosthesis, corresponding to the implantable portion 1*a* shown in FIGS. 7 and 8 includes a support plate 20 supporting two magnetic parts 18 intended to cooperate with the magnetic parts 8 of the implantable portion 1*a*, and a casing 19 containing the vibrator 11, and possibly the processor 13, the cell or battery 12, and, as the case may be, one or more microphones 14.

The external portion corresponding to the implantable portion 1*b* shown in FIG. 9 is substantially identical to that shown in FIGS. 11 and 12, except that it includes only one magnetic part associated with the vibrator 11 that cooperates with the magnetic part 8 so as to cause the implantable portion 1*b* to vibrate.

FIGS. 13 to 16 show non-passive alternatives 1*c*, 1*d* of the implantable portion. In this alternative, the implantable portion is active and thus includes a vibrator 11 coupled directly with a rod 2*c* so as to transmit vibrations generated by the vibrator to the inner ear, preferably in the external semicircular canal. The vibrator 11 is associated with attachment means 32 enabling it to be attached to the skull and is connected by electrical wires to an electronic processing casing 33, 33', which is itself connected by electrical wires to a circular antenna 34, rigidly connected to one or two magnetic parts 35. In the alternative shown in FIG. 13, the electronic processing casing 33 is separate from the circular antenna 34. The processing casing 33 can also be mounted directly on the vibrator 11. Similarly, the assembly of the antenna 34 and the magnetic parts 35 and the electronic casing 33' can be mounted on the vibrator 11. In this latter case, the rod 2*c* is preferably in the form of an elbow so as to prevent the risk of trauma in the event of a shock.

In the alternative shown in FIG. 14, the electronic casing 33' is encapsulated with the antenna 34. In the alternative shown in FIG. 15, the implantable portion 1*e* comprises its own cell or battery power supply 36. The antenna 34 makes it possible to ensure the transmission of signals and/or power transmitted by an external casing. This external casing can include a signal-processing unit, a cell or battery and possible one or more microphones 14. Indeed, in the devices that must include at least one microphone, the latter can either be placed in the external casing or connected thereto, or be implanted.

In FIG. 16, the antenna portion 34 of the implantable portion 1*c*, 1*d*, 1*e* is attached to the skull away from the portion comprising the vibrator 11 and the rod 2*c*. It should be noted that in these embodiments, the rod 2*c* does not need to be elbow-shaped because the vibrator 11 is also implanted, and, therefore, it is not necessary to provide a plate 3 implanted just under the skin, capable of receiving shocks.

In FIGS. 17 and 18, the external portion 10*c* corresponding to the internal portion shown in FIG. 13, 14 or 15 includes a casing 19' containing a signal processor 13 connected to an antenna 21 and to a power supply 12, and possibly to a microphone 14. It also includes one or two magnetic parts 18 corresponding to the magnetic parts 35 provided in the implantable portion so as to attach the external casing opposite the antenna 34. If there are two magnetic parts, they are attached to a support plate 20' with the casing'.

FIGS. 19 to 24 show alternatives of the invention comprising a passive (percutaneous) semi-implantable portion.

In FIGS. 19 and 20, the implantable portion 1*f* includes an elbow-shaped rod 2*f* having an elbow angle and a length between the elbow and its distal end intended to come into direct contact with the inner ear, identical to that described in reference to FIGS. 1 and 2. The other end of the rod 2 is rigidly connected to attachment means 41 such as a screw, intended to be attached to the patient's skull. The head of the screw 41 includes an attachment profile 43 designed to cooperate with a matching profile provided on an external casing 50, 50' shown in FIG. 21 or 22. This casing contains a vibrator 11, and possibly a signal processor 13 connected to the vibrator, and, as the case may be, to at least one microphone 14, as well as to a power supply 12 (FIG. 22). In the example shown in FIG. 21, the power supply 12 and the processor 13 are arranged in another casing 55 connected by an electrical connection to the casing 50.

The alternative of the invention shown in FIGS. 23 and 24 makes it possible to treat patients who are entirely deaf in one ear. Near the entirely deaf ear, a screw 41 (FIG. 24) is attached to the skull, making it possible to attach the casing 50' containing in particular the microphone, which enables vibrations to be generated, which are transmitted in the skull by bone conduction. Near the other ear, an implantable portion 1*g*, shown in FIG. 23, is attached, comprising a rod 2*f* as described above, rigidly connected not to a screw as shown in FIG. 19, but to means 45 for attaching the rod to the patient's skull, such as a disc provided for receiving a screw 46 intended to be screwed into the skull, with the end of the rod 2*f* being placed in contact with the non-defective inner ear, as shown in FIG. 20. In this way, the sounds capable of being perceived by the defective ear are transmitted by the skull in the form of vibrations by bone conduction, then by means of the rod 2*f* directly into the non-defective inner ear.

What is claimed is:

1. Inner ear stimulation prosthesis including excitation means (11) designed to generate vibrations capable of exciting a patient's ear, characterized in that it comprises an implantable portion (1, 1*a* to 1*g*), including a rod (2, 2*a*, 2*c*, 2*f*) capable of transmitting vibrations and that is designed so as to be capable of transmitting vibrations generated by the excitation means (11) directly to the patient's inner ear.

2. Prosthesis according to claim 1, characterized in that the rod (2, 2*a*, 2*c*, 2*f*) is designed to be placed in contact with a semicircular canal of the patient's inner ear.

3. Prosthesis according to claim 1 or 2, characterized in that the rod (2, 2*a*, 2*c*, 2*f*) is designed to be placed in contact with the external semicircular canal of the patient's inner ear.

4. Prosthesis according to claim 1 or 3, characterized in that the rod (2, 2*a*, 2*c*, 2*f*) is made of a hard and rigid biocompatible material selected from metals, plastic materials and ceramic materials.

5. Prosthesis according to one of claims 1 to 4, characterized in that the rod (2, 2*a*, 2*f*) has a cross-section with a flattened shape.

6. Prosthesis according to one of claims 1 to 5, characterized in that the rod (2, 2*a*, 2*f*) comprises at least one elbow (4) so as to be capable of connecting an external portion of the patient's skull to the inner ear without requiring complex surgery involving total anesthesia of the patient.

7. Prosthesis according to claim 6, characterized in that the rod (2, 2*a*, 2*f*) has a length between the elbow (4) and its end in contact with a portion of the patient's inner ear, between 20 and 30 mm and has an elbow angle between its two end portions of between 70° and 130°.

8. Prosthesis according to one of claims 1 to 7, characterized in that the surface of the implantable portion (1) is treated so as to prevent any osseointegration.

9. Prosthesis according to one of claims 1 to 8, characterized in that the rod (2*a*) is pivotably mounted on a support (7, 7').

10. Prosthesis according to one of claims 1 to 9, characterized in that the excitation means (11) are arranged in an external casing (10, 10', 10*a*) and are designed so as to generate vibrations intended to be transmitted through the patient's skin to a plate (3) rigidly connected to the rod (2, 2*a*).

11. Prosthesis according to claim 10, characterized in that the plate (3) has a substantially rectangular shape with foam edges of which the length is between 6 mm and 20 mm and the width is between 3 mm and 10 mm.

12. Prosthesis according to claim 10 or 11, characterized in that the external casing (10, 10', 10*a*) is integrated in an object capable of being held on the patient's head so that the excitation means (11) are arranged opposite the plate (3) of the implantable portion (1).

13. Prosthesis according to claim 12, characterized in that the object capable of being held on the patient's head is selected from either a pair of eyeglasses or a casing that fits around the ear.

14. Prosthesis according to one of claims 10 to 12, characterized in that the external casing (10*a*) includes at least one magnetic part (18) intended to cooperate with at least one magnetic part (8) provided in the implantable portion (1*a*, 1*b*) so as to hold the excitation means opposite the plate (3).

15. Prosthesis according to one of claims 1 to 8, characterized in that the excitation means (11) are integrated in the implantable portion (1*c*, 1*d*, 1*e*) and coupled directly with the rod (2*c*).

16. Prosthesis according to one of claims 1 to 8, characterized in that the rod (2*f*) is rigidly connected to attachment means (41, 45, 46) for attaching the rod to the patient's skull bone.

17. Prosthesis according to claim 16, characterized in that the excitation means (11) are housed in an external casing (50, 50') equipped with coupling means (51), so as to be removably attached through the patient's skin to attachment means (41, 41') intended to be attached to the patient's skull bone.

18. Prosthesis according to claim 17, characterized in that the external casing (50, 50') containing a microphone (14) is intended to be attached on the side of a totally defective ear of the patient, while the rod (2*f*) is intended to be attached so as to excite the other, non-defective, ear of the patient, with the vibrations generated by the excitation means being transmitted to the rod by bone conduction of the patient's skull bone.

19. Hearing aid, characterized in that it is consistent with one of claims 1 to 18.

20. Prosthesis for neurostimulation against tinnitus, characterized in that it is consistent with one of claims 1 to 19.

21. Prosthesis for neurostimulation against balance disorders, characterized in that it is consistent with one of claims 1 to 20.

22. Implantable prosthesis portion, characterized in that it is consistent with one of the previous claims.

* * * * *